US006886511B1

(12) United States Patent
Tong et al.

(10) Patent No.: US 6,886,511 B1
(45) Date of Patent: May 3, 2005

(54) LOST MOTION ASSEMBLY FOR A POPPET VALVE OF AN INTERNAL COMBUSTION ENGINE

(75) Inventors: Jie Tong, Sterling Heights, MI (US); Burak A. Gecim, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 18 days.

(21) Appl. No.: 10/819,401

(22) Filed: Apr. 7, 2004

(51) Int. Cl.[7] ..... F01L 1/34

(52) U.S. Cl. ..... 123/90.16; 123/90.12; 123/90.15; 123/198 F; 251/14; 251/30.01; 251/62

(58) Field of Search ..... 123/90.12, 90.15, 123/90.16, 90.31, 198 F; 251/14, 30.01, 251/57, 62, 63.4

(56) References Cited

U.S. PATENT DOCUMENTS

| | | | | |
|---|---|---|---|---|
| 3,612,015 | A * | 10/1971 | Hausknecht | 123/90.12 |
| 4,278,233 | A * | 7/1981 | Zurner et al. | 251/57 |
| 5,154,143 | A | 10/1992 | Stutzenberger | 123/90.12 |
| 6,244,257 | B1 | 6/2001 | Hu | 123/568.14 |
| 6,325,028 | B1 | 12/2001 | Albanello et al. | 123/90.12 |
| 6,736,092 | B2 * | 5/2004 | Borean et al. | 123/90.12 |

* cited by examiner

*Primary Examiner*—Thomas Denion
*Assistant Examiner*—Kyle M. Riddle
(74) *Attorney, Agent, or Firm*—Kathryn A. Marra

(57) ABSTRACT

A lost motion assembly for a valve of an internal combustion engine includes a cam, a cam piston which is spring biased to follow motion of the cam, a valve piston operatively engaged with a poppet valve, and an auxiliary piston. The cam piston, valve piston and auxiliary piston are in continuous contact with a fluid in an enclosed control chamber having a fixed volume, such that rotation of the cam causes displacement of the cam piston into the control chamber, which causes a corresponding displacement of at least one of the valve piston and auxiliary piston while the volume of fluid in the control chamber remains substantially constant.

20 Claims, 1 Drawing Sheet

LOST MOTION ASSEMBLY FOR A POPPET VALVE OF AN INTERNAL COMBUSTION ENGINE

TECHNICAL FIELD

The present invention relates to a lost motion assembly for a poppet valve of an internal combustion engine wherein a fixed volume control chamber is used in conjunction with a position-controlled auxiliary piston to control valve lift during cam rotation.

BACKGROUND OF THE INVENTION

The prior art includes various lost motion devices for adjustably controlling valve lift during cam rotation in an internal combustion engine. At low engine speeds, it is desirable to reduce cam lift to minimize the amount of air drawn into the cylinder to optimize efficiency and improve torque.

Prior art cam driven hydraulic lost motion devices achieve lost motion by bleeding fluid from a high pressure chamber. These systems do not optimize efficiency even with a recovery system, such as a spring-loaded accumulator, because fluid is pumped across a small orifice, which results in throttling losses.

SUMMARY OF THE INVENTION

The present invention provides a hydraulic lost motion device for variable valve lifting in an engine wherein the working fluid is not throttled, and the energy associated with the lost motion is stored in an auxiliary spring. This device enables valve deactivation, late intake valve opening, early intake valve closing and, if supplemented with the timing control function of a cam shaft phaser, this device can be used for engine load control eliminating conventional throttling. Therefore, the primary benefit of this device is improved fuel economy where the pumping losses associated with conventional throttling are eliminated. Late intake valve opening strategy also improves idle stability.

More specifically, the invention provides an internal combustion engine valve operating system, including a cam, a cam piston which is spring-biased to follow motion of the cam, a valve piston operatively engaged with a poppet valve for opening the poppet valve, and an auxiliary piston movable with respect to an adjustable stop member. The cam piston, valve piston and auxiliary piston are in continuous contact with a fluid in an enclosed control chamber having a fixed volume, such that displacement of the cam piston into the control chamber causes movement of the valve piston and/or auxiliary piston, depending upon the adjusted position of the adjustable stop member, while the volume of fluid in the control chamber remains substantially constant.

The control chamber is formed within a housing, and the cam piston, valve piston and auxiliary piston are movably positioned within the housing. The control chamber is formed by interconnected passages which are drilled into the housing. The adjustable stop member includes a screw which is threadedly engaged with a holding nut attached to the housing. The screw is attached to a stepper motor to adjust the position of the screw. The auxiliary piston is engaged with an auxiliary piston spring which biases the auxiliary piston away from the screw into the control chamber.

A valve spring biases the poppet valve toward a closed position. The valve spring is stiffer than the auxiliary piston spring. The screw has a distal end which is abuttable against the auxiliary piston. The valve piston has a tapered head to facilitate soft seating of the valve.

The adjustable stop member is adjustable between a retracted position in which the poppet valve is deactivated and does not open when the cam rotates, and an extended position in which the auxiliary piston does not move so that the entire volume of fluid displaced by the cam piston causes movement of the valve piston for maximum valve opening. The adjustable stop member also is infinitely adjustable by a stepper motor between the retracted and extended positions to vary the amount of valve lift during each cam rotation.

The holding nut is adjustable to preset the specific force induced against the auxiliary piston by the auxiliary piston spring, which is trapped between the holding nut and the auxiliary piston. A radial rim of the auxiliary piston abuts a shoulder of the housing.

In another embodiment, the holding nut and screw forming the stop member are combined into a single screw with a threaded head portion which is threadedly engaged with the housing, and the screw has a distal end which is engageable with the auxiliary piston to act as a stop.

The invention may alternatively be implemented with a roller-finger-follower device between the cam and the cam piston.

The above features and advantages, and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
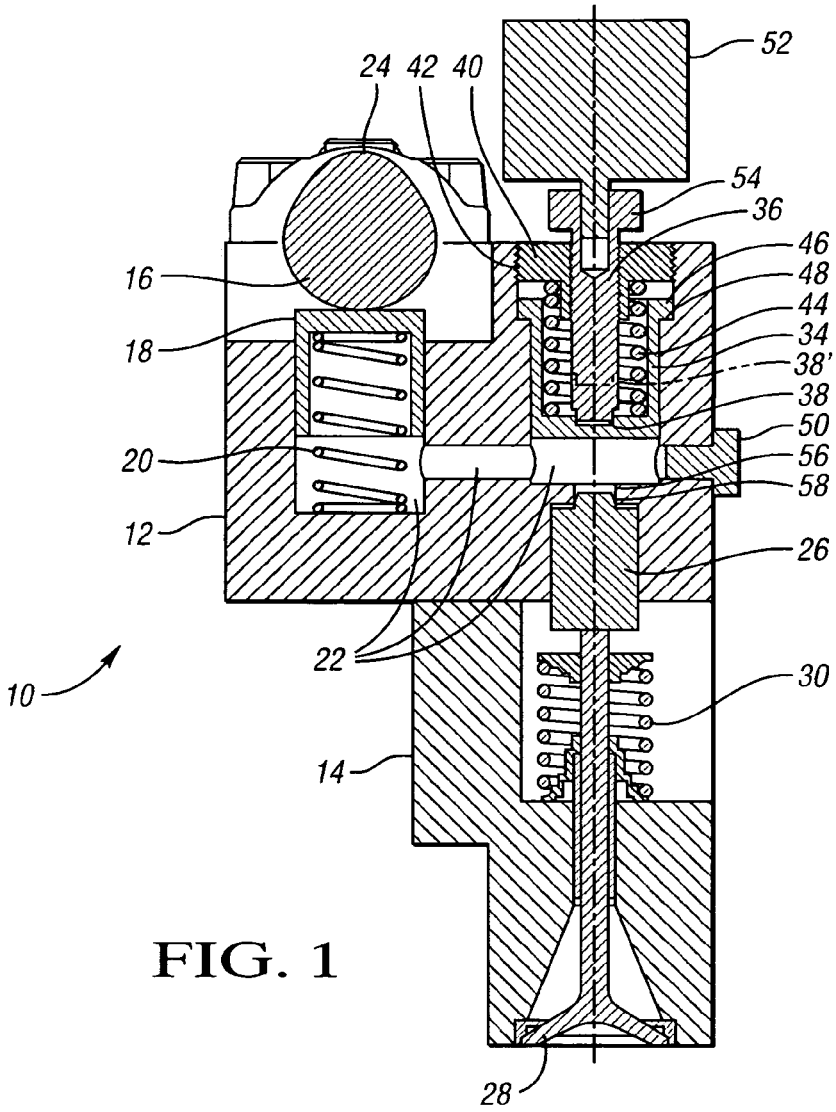
FIG. 1 shows a cross sectional view of a lost motion assembly for a valve of an internal combustion engine in accordance with the invention.

Referring to FIG. 1, a cross sectional view of a lost motion assembly 10 is shown in accordance with a preferred embodiment of the invention. As shown, the lost motion assembly 10 includes a housing 12 which is connected to a head 14 of an engine including a rotatable cam 16. A cam piston 18 is spring biased toward the cam 16 by the spring 20 so that the cam piston 18 reciprocates up and down in the control chamber 22 as the cam 16 rotates such that the cam lobe 24 regularly engages the cam piston 18.

A valve piston 26 is also in continuous engagement with the control chamber 22, and is connected with the cylinder valve 28 (i.e., poppet valve) to facilitate opening and closing of the poppet valve 28 as the valve piston 26 moves against the valve-closing bias of the valve spring 30.

An auxiliary piston 34 is also in continuous contact with the control chamber 22, and is reciprocatable up and down with respect to the control chamber 22. The auxiliary piston 34 is movable with respect to an adjustable screw 36, which is operative as a stop member. The adjustable screw 36 has a distal end 38 which is abuttable against the auxiliary piston 34 to limit upward movement of the piston 34. The adjustable screw 36 is threadedly engaged with a holding nut 40, which is threaded to the housing 12 by the threads 42. An auxiliary piston spring 44 is trapped between the holding nut 40 and the auxiliary piston 34. The holding nut 40 is threaded into the housing 12 and properly adjusted to preset the specific force induced against the auxiliary piston 34 by the auxiliary piston spring 44, as the rim 46 of the auxiliary piston 34 abuts the shoulder 48 of the housing 12.

Any linear motor could be used to adjust the holding nut 40, but the stepper motor can be very small because there is minimal opposing force in adjusting the screw 36.

The control chamber 22 is formed by the various passages which are drilled into the housing 12, and the control chamber is bordered by the cam piston 18, auxiliary piston 34, and valve piston 26. The control chamber 22 is closed by the plug 50, which may be a one-way check valve.

The adjustable screw 36 is adjustable up and down with respect to the holding nut 40 by the stepper motor 52 which is engaged with the head 54 of the screw 36 for adjusting the vertical position of the distal end 38 of the screw 36, which operates as a stop member.

Accordingly, the cam piston 18, valve piston 26, and auxiliary piston 34 are all in continuous contact with the fluid in the control chamber 22 such that these pistons 18, 26, 34 are in "fluid communication" with each other. The trapped volume of fluid inside the control chamber 22 may be replenished through a one-way valve (50) to compensate for leakage when all three pistons 18, 26, 34 are in their seated positions.

In operation, the volume displaced by the cam piston 18 equates approximately to the summation of the volumes displaced by the auxiliary piston 34 and valve piston 26. A small amount of volumetric loss results from fluid compressibility and leakage through piston-to-wall clearances. As it is known in the relevant art, the input motion from the cam 16 has a fixed displacement-time characteristic determined from the cam profile. However, the output motion of the poppet valve 28 can be varied by controlling the auxiliary piston 34 motion. In turn, one of the two operating parameters that control the auxiliary piston displacement is the relative values of the specific force (i.e., force per unit piston area) induced by the valve spring 30 and auxiliary piston spring 44. The other controlled parameter is the displacement of the positioning screw 36, which serves as a dead stop that limits the upward displacement of the auxiliary piston 34.

Specifying the diameters of each one of the cam piston 18, auxiliary piston 34, and valve piston 26 determines their individual linear displacements per fixed cam displacement. Hence, for example, if the linear displacement authority of the stepper motor 52 and the screw 36 is limited, then the auxiliary piston diameter has to increase. Once the piston dimensions are fixed, however, the poppet valve timing (e.g., valve opening point) can be determined by proper selection of the relative values for valve and auxiliary biasing spring (30, 44) properties. For a late intake valve opening (LIVO) strategy, the auxiliary piston's (34) specific preload, which is determined by its spring characteristics and the position of the holding nut 40, has to be smaller than that of the valve spring 30. This will ensure a delay in the opening point of the poppet valve 28 where displaced volume of the cam piston 18 approximately equals the displaced volume of the auxiliary piston 34.

The exact timing of the poppet valve 28 liftoff is controlled by the dead stop function of the positioning screw 36 alone. In other words, valve lift off is enabled even when the specific loading of the valve spring 30 is larger than that of the auxiliary spring 44. Valve lift off can also be enabled if the specific loading of the auxiliary piston 34 (already in lost motion) becomes equal to that of the valve spring 30 prior to the auxiliary piston 34 reaching the dead stop defined by the distal end 38 of the screw 36.

Simultaneous displacement of both the auxiliary piston 34 and valve piston 26 is important because it enables a softer poppet valve 28 lift off and auxiliary piston 34 landing due to the shared displacement of the driving cam, and smoothly rising pressure in the control chamber 22. With the dead stop position control alone, chamber pressure will have a step change at the instant of auxiliary piston 34 landing that results in a high inertial loading on all components. This is somewhat remedied by auxiliary spring 44 force, and can further be remedied by damping of the auxiliary piston 34 motion prior to its landing at the dead stop 38 at the distal end of the screw 36.

Soft landing of the auxiliary piston 34 onto the dead stop 38, and soft seating of the poppet valve 28 are achieved by employing variable rate damping. The variable damping rate results from the tapered piston head 56 plunging into the oil filled control chamber 22. A progressively decreasing bleed area formed between the tapered piston head 56 and the straight edged reservoir 58 yields improved damping with the valve piston 26 flowing down as it plunges into the reservoir 58.

As described previously, the cam piston 18, valve piston 26 and auxiliary piston 34 are in continuous contact with the fluid in the enclosed control chamber 22 which maintains a fixed volume for the fluid as the pistons 18, 26, 34 reciprocate. Accordingly, displacement of the cam piston 18 into the control chamber 22 causes movement of the valve piston 26 and/or the auxiliary piston 34, depending upon the adjusted position of the adjustable screw 36, while the volume of fluid in the control chamber 22 remains substantially constant. When the adjustable screw 36 is in the fully extended position, such as that shown in FIG. 1, the auxiliary piston 34 is unable to move upward so that the entire volume of fluid displaced by downward movement of the cam piston 18 causes corresponding movement of the valve piston 26 from maximum opening of the poppet valve 28. When the adjustable screw 36 is in the retracted position shown in phantom by reference 38' in FIG. 1, the cylinder valve 28 is deactivated and does not open when the cam 16 rotates because the entire volume of fluid displaced by the cam piston 18 is accommodated by corresponding displacement of the auxiliary piston 34. The distal end 38 of the screw 36 is infinitely adjustable between the retracted and extended positions by the stepper motor 52 to vary the amount of valve lift during each cam rotation.

Accordingly, in the present invention, the working fluid within the control chamber 22 is not throttled, and the energy associated with the lost motion is stored in the auxiliary spring 44. The controls associated with this system are relatively simple because the auxiliary piston's dead stop position does not have to be modulated per valve event. Also, because this system does not involve fluid throttling across a small orifice, its performance sensitivity to viscosity variations is negligible and fluidic head loss is minimal.

As mentioned previously, this invention may be used with a non-throttled engine, and poppet valve lift may be controlled to control the air intake, as opposed to using a throttle valve.

As an alternative to the configuration shown in FIG. 1, a roller finger follower may be positioned between the cam and the cam piston. Roller finger followers are known in the art. For example, a roller finger follower is shown in commonly owned U.S. patent application Ser. No. 10/393,292, filed Mar. 18, 2003, which is hereby incorporated by reference in its entirety.

This device may also be combined with a cam phaser to provide fully flexible valve timing.

Figure 2:
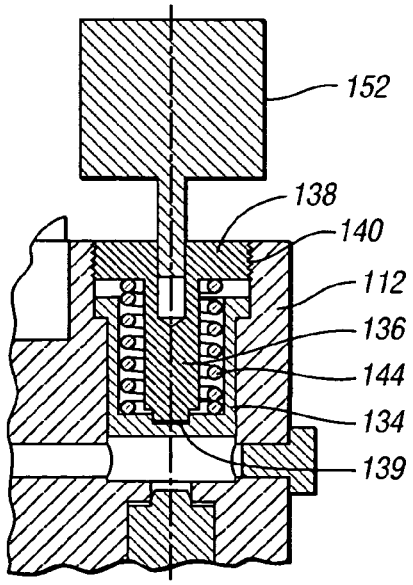
FIG. 2 shows a partial cross sectional view of a lost motion assembly in accordance with an alternative embodiment of the invention.

With the fixed auxiliary piston preload of the embodiment shown in FIG. 1, only a single, specific valve lift off point is available prior to the auxiliary piston reaching the dead stop. However, referring to the embodiment shown in FIG. 2, where both the dead stop function of the positioning screw and the auxiliary piston spring preload can be controlled, lift off of the poppet valve prior to the auxiliary piston reaching the dead stop is continuously possible for different valve lift off points. Referring specifically to FIG. 2, the adjusting screw, holding nut, and screw head of FIG. 1 have been combined into a single screw 136 having a head 138 which is threaded along the threads 140 to the housing 112. An auxiliary piston spring 144 is positioned between the head 138 of the screw 136 and the auxiliary piston 134. The distal end 139 of the screw 136 is abuttable against the auxiliary piston 134 to function as an absolute stop. The distal end 139 is adjustable by adjusting the screw 136 with respect to the housing 112 via the stepper motor 152. Accordingly, in this configuration, both the preload on the auxiliary piston spring 144 and the position of the distal end 139 of the screw 136 are simultaneously adjustable and controllable during engine operation, thereby providing greater flexibility in valve control.

While the best modes for carrying out the invention have been described in detail, those familiar with the art to which this invention relates will recognize various alternative designs and embodiments for practicing the invention within the scope of the appended claims.

What is claimed is:

1. An internal combustion engine valve operating system comprising:

a cam;

a cam piston which is spring-biased to follow motion of said cam;

a valve piston operatively engaged with a poppet valve for opening the poppet valve; and an auxiliary piston movable with respect to an adjustable stop member;

wherein said cam piston, valve piston and auxiliary piston are in continuous contact with a fluid in an enclosed control chamber having a fixed volume, such that displacement of said cam piston into said control chamber causes movement of said valve piston and/or said auxiliary piston, depending on the adjusted position of said adjustable stop member, while the volume of fluid in said control chamber remains substantially constant.

2. The internal combustion engine valve operating system of claim 1, wherein said control chamber is formed within a housing, and said cam piston, valve piston and auxiliary piston are movably positioned in the housing.

3. The internal combustion engine valve operating system of claim 2, wherein said adjustable stop member comprises a screw which is threadedly engaged with a holding nut attached to said housing, said screw being attached to a stepper motor to adjust the position of the screw, and said auxiliary piston being engaged with an auxiliary piston spring which biases said auxiliary piston away from said screw into said control chamber.

4. The internal combustion engine valve operating system of claim 3, further comprising a valve spring biasing said poppet valve toward a closed position, said valve spring being stiffer than said auxiliary piston spring.

5. The internal combustion engine valve operating system of claim 2;

wherein said control chamber is formed by interconnected passages which are drilled into said housing.

6. The internal combustion engine valve operating system of claim 1, wherein said adjustable stop member is adjustable between a retracted position in which the poppet valve is deactivated and does not open when the cam rotates, and an extended position in which said auxiliary piston does not move so that the entire volume of fluid displaced by the cam piston causes movement of the valve piston for maximum valve opening.

7. The internal combustion engine valve operating system of claim 6, wherein said adjustable stop member is infinitely adjustable by a stepper motor between said retracted and extended positions to vary the amount of valve lift during each cam rotation.

8. The internal combustion engine valve operating system of claim 3, wherein said screw has a distal end which is abuttable against said auxiliary piston.

9. The internal combustion engine valve operating system of claim 1, wherein said cam piston and auxiliary piston are hollow.

10. The internal combustion engine valve operating system of claim 1, wherein said valve piston has a tapered head to facilitate soft seating of the valve.

11. The internal combustion engine valve operating system of claim 3, wherein said holding nut is adjustable to pre-set the specific force induced against the auxiliary piston by the auxiliary piston spring.

12. The internal combustion engine valve operating system of claim 1, wherein said control chamber is formed within a housing, and said stop member comprises a screw with a threaded head portion which is threadedly engaged with said housing and said screw having a distal end which is engageable with said auxiliary piston to act as a stop.

13. A lost motion assembly for a poppet valve of an internal combustion engine comprising:

a cam;

a cam piston which is spring-biased to follow motion of said cam;

a valve piston operatively engaged with a poppet valve for opening the poppet valve; and an auxiliary piston;

wherein said cam piston, valve piston and auxiliary piston are in continuous contact with a fluid in an enclosed control chamber having a fixed volume, such that rotation of said cam causes displacement of said cam piston into said control chamber, which causes a corresponding displacement of at least one of said valve piston and said auxiliary piston while the volume of fluid in said control chamber remains substantially constant; and wherein the allowable range of movement of said auxiliary piston is controllable such that the resulting valve lift of said poppet valve may be adjusted between a deactivated condition in which there is lost motion between the cam and the poppet valve, and a fully openable condition in which there is no lost motion.

14. The assembly of claim 13, wherein said auxiliary piston is movable with respect to an adjustable stop member, and said resulting valve lift of said poppet valve may be controlled by adjusting said stop member.

15. The assembly of claim 14, wherein said control chamber is formed within a housing, and said cam piston, valve piston and auxiliary piston are movably positioned in the housing.

16. The assembly of claim 15, wherein said adjustable stop member comprises a screw which is threadedly engaged with a holding nut attached to said housing, said screw being attached to a stepper motor to adjust the position of the screw, and said auxiliary piston being engaged with an auxiliary piston spring which biases said auxiliary piston away from said screw into said control chamber.

17. The assembly of claim 16, further comprising a valve spring biasing said poppet valve toward a closed position, said valve spring being stiffer than said auxiliary piston spring.

18. The assembly of claim 14, wherein said adjustable stop member is infinitely adjustable by a stepper motor to vary the amount of valve lift during each cam rotation.

19. The assembly of claim 13, wherein said control chamber is formed within a housing, and said stop member comprises a screw with a threaded head portion which is threadedly engaged with said housing and said screw having a distal end which is engageable with said auxiliary piston to act as a stop.

20. An internal combustion engine valve operating system comprising:

a cam;

a cam piston which is spring-biased to follow motion of said cam;

a valve piston operatively engaged with a poppet valve for opening the poppet valve;

an auxiliary piston movable with respect to an adjustable stop member;

wherein said cam piston, valve piston and auxiliary piston are in continuous contact with a fluid in an enclosed control chamber having a fixed volume, such that displacement of said cam piston into said control chamber causes movement of said valve piston and/or said auxiliary piston, depending on the adjusted position of said adjustable stop member, while the volume of fluid in said control chamber remains substantially constant;

wherein said control chamber is formed within a housing, and said cam piston, valve piston and auxiliary piston are movably positioned in the housing; and wherein said adjustable stop member comprises a screw which is threadedly engaged with a holding nut attached to said housing, said screw being attached to a motor which adjusts the position of the screw.

* * * * *